United States Patent [19]

Toniatti

[11] Patent Number: 5,052,321

[45] Date of Patent: Oct. 1, 1991

[54] TROLL CONTROL APPARATUS

[76] Inventor: Fred G. Toniatti, 6806 Chandler Dr., Sacramento, Calif. 95828

[21] Appl. No.: 663,109

[22] Filed: Feb. 28, 1991

[51] Int. Cl.[5] ..... P63H 25/52

[52] U.S. Cl. ..... 114/172

[58] Field of Search ..... 114/144 R, 153, 162, 114/170, 172; 74/480 B, 494, 495; 440/6, 63

[56] References Cited

U.S. PATENT DOCUMENTS

| | | | |
|---|---|---|---|
| 2,543,553 | 2/1951 | McAllister . | |
| 2,846,896 | 8/1958 | Allen | 114/172 |
| 3,279,410 | 10/1966 | Young . | |
| 3,288,099 | 11/1966 | Bittner . | |
| 3,371,641 | 3/1968 | Rohman et al. | 440/63 |
| 3,517,634 | 6/1970 | Irgens | 114/172 |
| 4,178,869 | 12/1979 | Turrentine . | |
| 4,188,904 | 2/1980 | Childress | 114/172 |
| 4,476,800 | 10/1984 | Gage . | |
| 4,480,572 | 11/1984 | Lauterbach . | |

*Primary Examiner*—Jesûs D. Sotelo
*Assistant Examiner*—Stephen P. Avila
*Attorney, Agent, or Firm*—John P. O'Banion

[57] ABSTRACT

An apparatus for continuous adjustment of the direction of the rudder position of an outboard motor powered boat while trolling and permitting the fisherman's hands to be free as the boat follows the desired course. A tubular sleeve (24) slides over a rod (18) which is pivotally attached to a mounting bracket (10) affixed to the side of the boat. The sleeve (24) includes a pin (26) for engaging a hole (48) in a pilot bracket (38) attached to the outboard motor (40) or the tiller (52) of the boat, and a rotatable mechanism (34) to lock the sleeve to the rod. Sliding the sleeve (24) along the rod (18) changes the rudder position of the boat, the position being fixed when the sleeve (24) is locked to the rod (18). Manual operation is restored by lifting the rod (18) to disengage the pin (26) from the pilot bracket (38).

13 Claims, 3 Drawing Sheets

TROLL CONTROL APPARATUS

BACKGROUND OF THE INVENTION

1. Field of the Invention

This invention relates generally to devices for controlling the direction of travel of small water craft, and more particularly to an apparatus for fixing the position of the rudder of a small water craft for unattended trolling.

2. Description of the Background Art

Use of outboard motor powered boats by fisherman is widely known. Often these boats are used for slow speed trolling because certain fish more readily strike a lure that is dragged behind a slow moving boat than when the lure is stationary. However, it is difficult to control the direction of the boat by operating a tiller or steering control while at the same time holding a rod and reel.

Several devices have been proposed for fixing the position of tillers used with wind powered sail boats. Examples are U.S. Pat. No. 4,480,572 issued to Lauterbach on Nov. 6, 1984; U.S. Pat. No. 4,476,800 issued to Gage on Oct. 16, 1984; U.S. Pat. No. 4,188,904 issued to Childress on Feb. 19, 1980; U.S. Pat. No. 4,178,869 issued to Turrentine on Dec. 18, 1979; and U.S. Pat. No. 3,279,410 issued to Young on Oct. 18,1966. While these devices can be used to fix the position of a tiller for unattended sailing, none provide for simple sliding movement for adjustment of the rudder attached to an outboard motor over a continuous range while at the same time providing for quick one-handed disconnection of the device in the event that manual steering is desired.

Other devices have been proposed for steering boats powered by outboard motors, including fixing the position of the tiller. Examples of those devices can be found in U.S. Pat. No. 3,288,099 issued to Bittner on Nov. 29, 1966; U.S. Pat. No. 2,846,896 issued to Allen on Aug. 12, 1958; and U.S. Pat. No. 2,543,553 issued to McAllister on Feb. 27, 1951. These devices are deficient in one or more respects in that they either require the fisherman to hold the tiller in place so that 15 he is not free to move around the vessel, do not provide for quick release of the device in an emergency, or do not provide for a continuous range of position adjustment.

The foregoing patents reflect the state of the art of which the applicant is aware and are tendered with the view toward discharging applicant's acknowledged duty of candor in disclosing information which may be pertinent in the examination of this application. While the devices disclosed in those patents can be used to fix the position of a tiller, they do not exhibit the features and objectives of the present invention. It is respectfully stipulated that none of these patents teach or render obvious, singly or when considered in combination, applicant's claimed invention.

SUMMARY OF THE INVENTION

The present invention is an apparatus which permits the pilot of a boat powered by an outboard motor to fix the position of the rudder while trolling. According to the present invention, one end of a metal mounting bracket is attached to the side wall of the boat. The other end of the mounting bracket is attached to a cylindrical rod. Attachment is made by inserting a sigmoidal-shaped end of the rod into a hole in the bracket. When inserted, the rod is capable of pivoting horizontally about a vertical axis. However, the rod cannot be disengaged from the bracket when pivoted in this manner. A second bracket, or pilot bracket, is either attached to the outboard motor directly, or is attached to a tiller handle used with the motor. The pilot bracket is typically L-shaped, with one leg attached to the motor or tiller handle. The other leg contains several holes and is oriented to form a horizontal surface.

The cylindrical rod is inserted into a sleeve which can slide over the rod from end to end. Attached to the sleeve is a pin which is oriented substantially perpendicular to the surface of the sleeve. Positioned on the surface of the sleeve directly opposite to the point at which the pin is attached, is a hole. Attached to sleeve directly over that hole is a threaded nut. One end of a bolt is threaded into that nut; the other end is attached to a knurled disc-shaped knob. When the knurled knob is rotated, the bolt tightens against the rod prevents the sleeve from sliding.

The pin attached to the sleeve engages one of the holes in the pilot bracket. In this manner, the position of the outboard motor and, therefore, the rudder, can be fixed. To use the present invention, the sleeve is positioned along the rod at a point where the pin engages a hole in the pilot bracket. The sleeve is then positioned along the rod to a point at which the rudder is pointing in the desired direction. The knurled knob is rotated, thus locking the sleeve into position. In event that it is necessary to retain manual control of the outboard motor, the rod is lifted to disengage the pin from the pilot bracket.

An object of the invention is to fix the rudder position of an outboard motor while trolling.

Another object of the invention is to permit a fisherman to troll in a fixed direction while having his hands free for holding a rod and reel.

Another object of the invention is to fix the rudder position of an outboard motor without being affected by rotational motion of the propeller.

Another object of the invention is to provide for continuous directional adjustment.

Another object of the invention is to permit hands free directional control while trolling.

Another object of the invention is to provide for quick release for manual directional control when desired.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
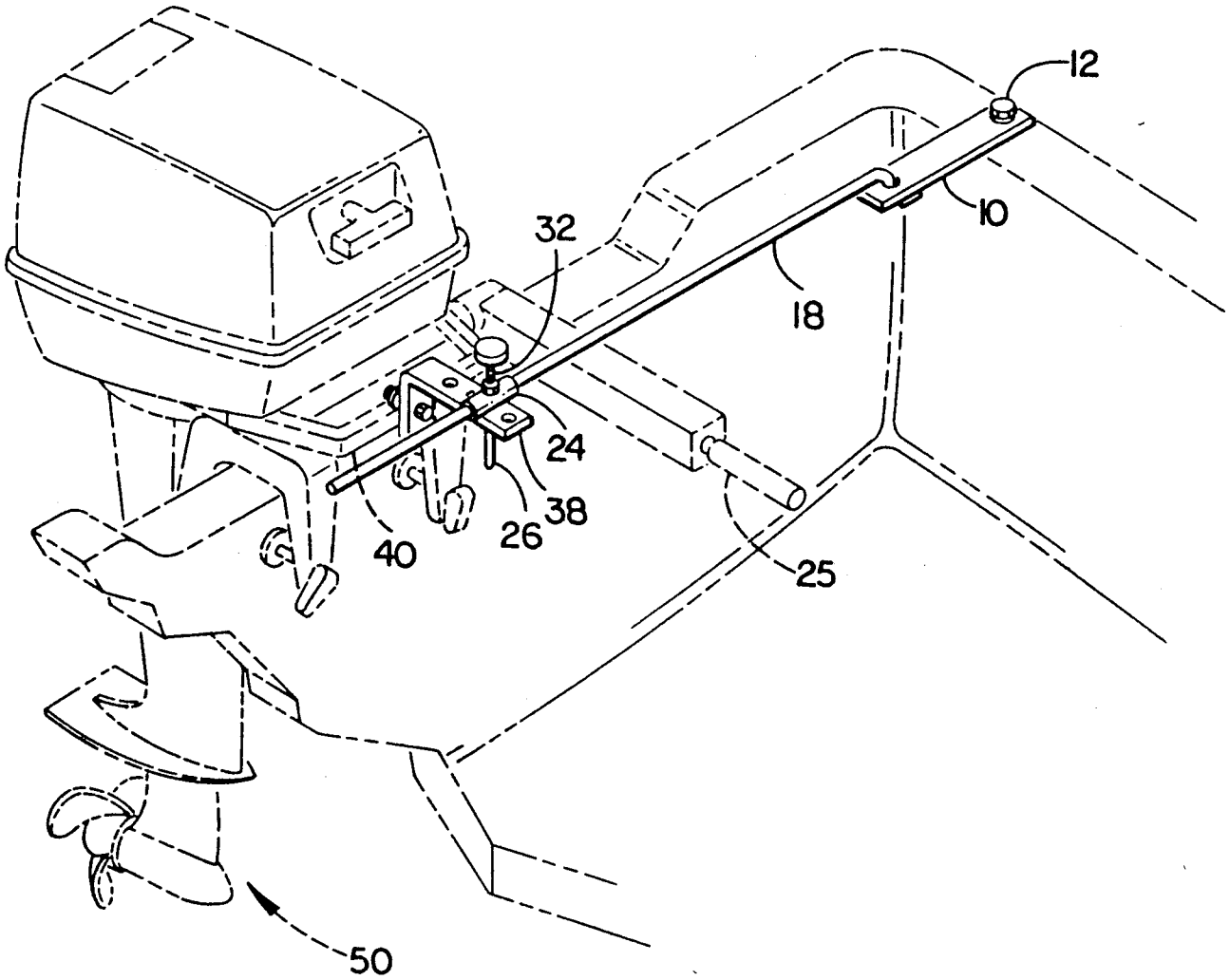
FIG. 1 is a perspective view of the apparatus of the present invention attached to an outboard motor powered boat shown in phantom.
Figure 2:
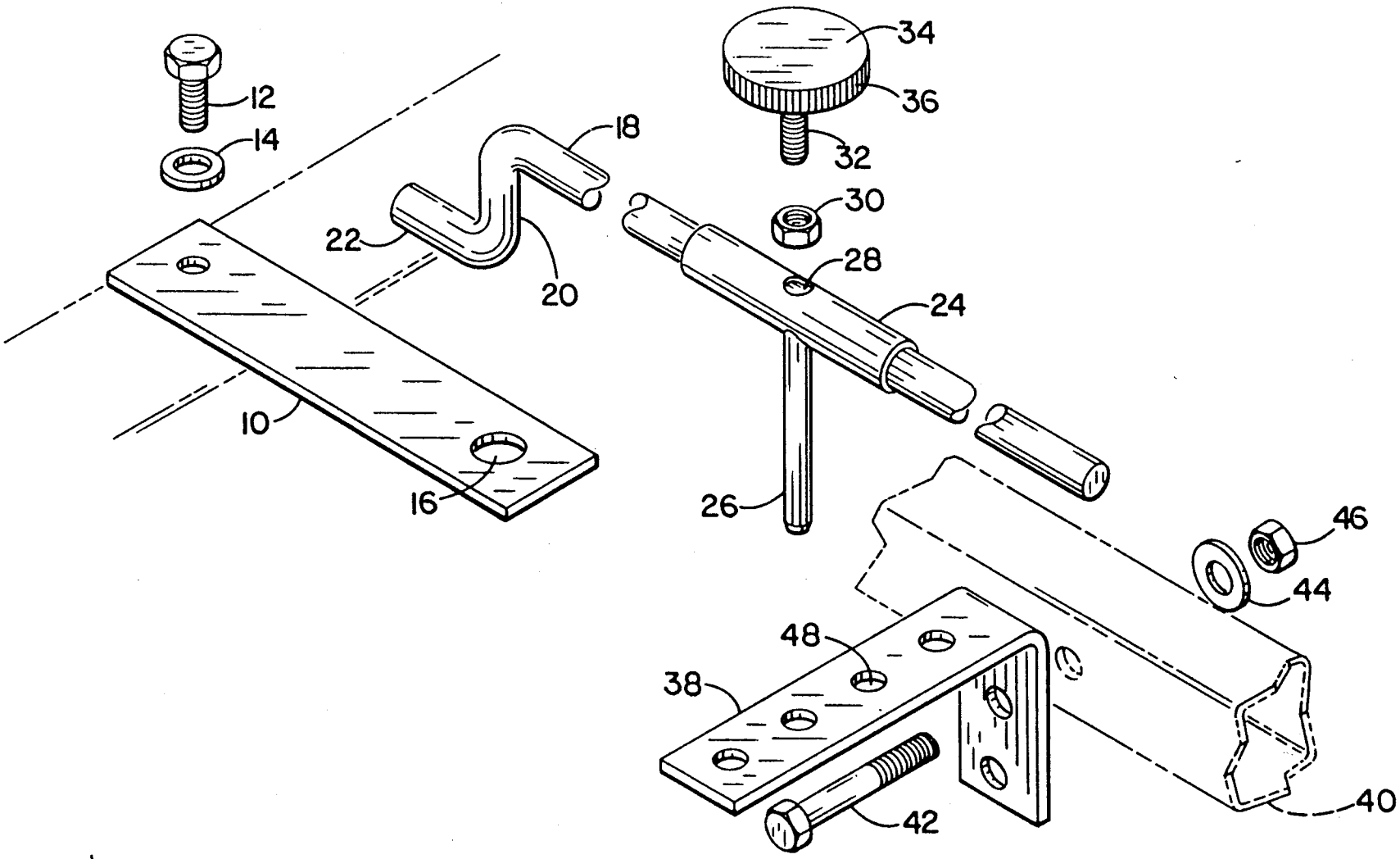
FIG. 2 is a perspective exploded view of the present invention.
Figure 3:
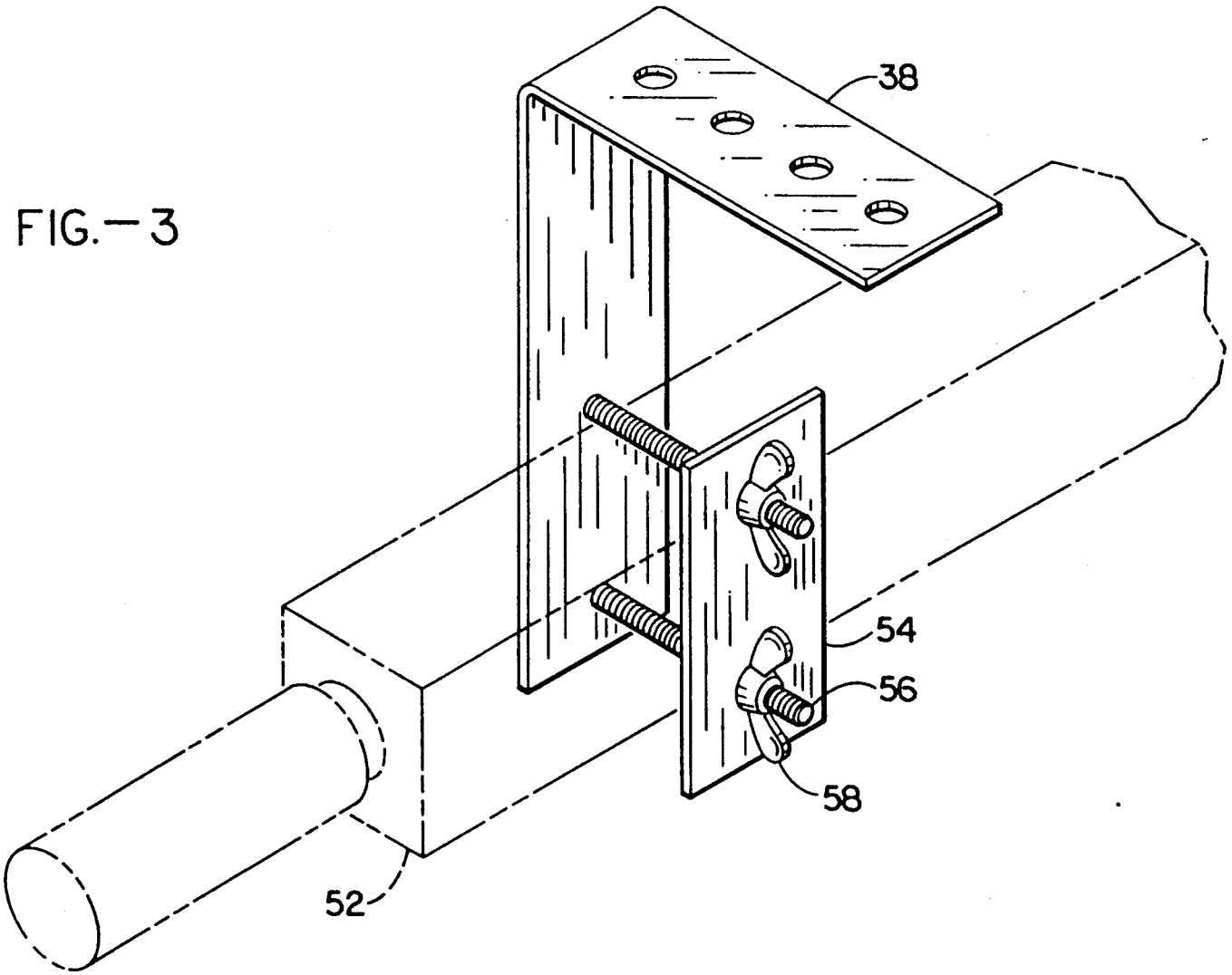
FIG. 3 is a perspective view of the pilot bracket of the present invention attached to a tiller handle shown in phantom.

Referring more specifically to the drawings, for illustrative purposes the present invention is embodied in the apparatus generally shown in FIG. 1 through FIG. 3. It will be appreciated that the apparatus may vary as to configuration and as to details of the parts without departing from the basic concepts as disclosed herein.

Referring to FIG. 1 and 2, a metal mounting bracket 10 is attached to the side or gunwale of a boat by screws or a bolt 12 and washer 14. At one end of mounting bracket 10 is a hole 16 into which rod 18 is inserted. To permit rod 18 to articulate in hole 16, one end of rod 18 is sigmoidal. This is accomplished by bending one end of rod 18 to form a first leg 20 that is oriented substantially perpendicular to rod 18 and a second leg 22 which is oriented substantially perpendicular to leg 20 and substantially parallel to rod 18. As an alternative means to bending one end of rod 18 in this fashion, legs 20, 22 could be separate elements attached end to end to rod 18. To attach rod 18 to mounting bracket 10, rod 18 is oriented vertically, one end of leg 22 is inserted into hole 16, and then rod 18 is re-oriented horizontally so that leg 20 becomes a pivot point in hole 16. While one end of rod 18 could simply have a vertical oriented pin for insertion into hole 16, such an embodiment can be prone to popping out due to vibration. Therefore, it is preferred to attach rod 18 to bracket 10 as herein described or by equivalent means which permits rod 26 to articulate horizontally about a vertical axis without being prone to popping out.

Sleeve 24, which is a hollow metal tube or the like, is threaded over rod 18 as shown for sliding motion from one end of rod 18 to the other. Pin 26 is welded or otherwise rigidly attached to sleeve 24 with a generally vertical orientation. It will thus be seen that pin 26 is also orientated substantially perpendicular to the surface of sleeve 24. Located directly opposite pin 26 is hole 28 in sleeve 24 over which receptacle 30 is positioned. Receptacle 30 is preferably a threaded nut which has been welded or otherwise rigidly attached to sleeve 24.

One end of a threaded bolt 32 is inserted into receptacle 30 as shown. The other end of threaded bolt 32 is attached to disc-shaped knob 34 which has knurled edges 36. Threaded bolt 32 is welded or otherwise rigidly attached to one face of knob 34 in a substantially perpendicular orientation. When knob 34 is rotated, threaded bolt 32 can be made to protrude through hole 28 until it engages rod 18, thus locking sleeve 24 to rod 18.

In an alternative embodiment, sleeve 24 is fashioned from a square, rectangular, or cylindrical piece of metal stock. In that embodiment, a round hole would be drilled from end to end for insertion of rod 18. Additionally, receptacle 30 would be fashioned by drilling hole 28 in sleeve 24 and then tapping it so that it contains integral threads to receive threaded bolt 32. Pin 26 would then be attached by drilling a second hole into sleeve 24, tapping that hole, and cutting threads on one end of pin 26. In this way, pin 26 would be threaded into sleeve 24.

Pilot bracket 38 is typically attached to a channel brace 40 on the outboard motor by a bolt 42, a washer 44, and a nut 46. As can be seen in FIG. 2, pilot bracket 38 is an L-shaped bracket with one leg forming a horizontal self. On that shelf are a plurality of holes 48 through which pin 26 is inserted for control of the position of the outboard motor, more particularly rudder 50 shown in FIG. 1.

To fix the position of rudder 50 for unattended trolling, sleeve 24 is moved along rod 18 until the desired direction is achieved and sleeve 24 is then locked into position on rod 18 by threaded bolt 32. In the event that it is desired to change the direction of trolling, threaded bolt 32 is loosened and sleeve 24 repositioned along rod 18. Furthermore, in the event that manual control is desired or must be achieved in the event of an emergency, rod 18 is lifted vertically until pin 26 is disengaged from hole 48.

Referring now to FIG. 3, in an alternative embodiment pilot bracket 38 is attached to the tiller handle 52 of the boat. Plate 54 is placed on one side of tiller handle 52, while pilot bracket 38 is placed on the other side, the two members being clamped to tiller handle 52 by bolts 56 and nuts 58 or the like.

Accordingly, it will be seen that the present invention provides a fisherman with the ability to lock the rudder of the boat in place while fishing, leaving his hands and feet free for other functions performed in the boat. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A troll control apparatus, comprising:

(a) a cylindrical rod;

(b) a mounting bracket, said mounting bracket for attachment to a wall of a boat, said mounting bracket having a hole;

(c) rod articulating means for insertion into said hole in said mounting bracket and articulation of said rod about a substantially vertical axis, said rod articulating means attached to one end of said rod;

(d) a sleeve, said rod inserted through said sleeve, said sleeve being slidable over said rod;

(e) a pin, said pin attached to said sleeve, said pin oriented substantially perpendicular to the longitudinal axis of said sleeve;

(f) a pilot bracket, said pilot bracket having a plurality of holes for mating with said pin;

(g) fastening means for fastening said pilot bracket to an outboard motor powering said boat; and (h) locking means for locking said sleeve to said rod to fix the position of a rudder attached to said outboard motor.

2. The apparatus recited in claim 1, wherein said fastening means comprises a bolt and a nut.

3. The apparatus recited in claim 1, wherein said fastening means comprises:

(a) a plate, said plate having a plurality of holes;

(b) a plurality of bolts, said bolts extending through said holes in said plate, said bolts extending through holes in said pilot bracket; and (c) a plurality nuts, said nuts engaging said bolts, said plate and said pilot bracket positioned over the tiller of said outboard motor and clamped thereto.

4. The apparatus recited in claim 1, wherein said locking means comprises:

(a) a threaded receptacle, said receptacle attached to said sleeve, said receptacle positioned over a hole in said sleeve; and (b) a threaded bolt, said bolt having a first end and a second end, said first end of said bolt engaging said threads in said receptacle and extending through said hole in said sleeve, said second end of said bolt attached to a disc-shaped knob substantially perpendicular to one face of said knob, said knob having knurled edges.

5. The apparatus recited in claim 1, wherein said rod articulating means comprises a plurality of bends in said rod near one end, said bends forming a first leg, the longitudinal axis of said first leg being substantially perpendicular to the longitudinal axis of said rod, and a second leg, the longitudinal axis of said second leg being substantially perpendicular to the longitudinal axis of said first leg, said second leg for insertion into said hole in said mounting bracket.

6. The apparatus recited in claim 5, wherein the longitudinal axis of said second leg is substantially parallel to the longitudinal axis of said rod.

7. An apparatus for fixing the position of a rudder in an outboard motor powered boat for unattended trolling, comprising:

(a) a cylindrical rod, one end of said rod being sigmoidal;

(b) a mounting bracket, said mounting bracket for attachment to a wall of a boat, said mounting bracket having a hole, said hole receiving said sigmoidal end of said rod for articulation of said rod about a substantially vertical axis;

(c) a sleeve, said rod inserted through said sleeve, said sleeve being slidable over said rod;

(d) a pin, said pin attached to said sleeve, said pin oriented substantially perpendicular to the longitudinal axis of said sleeve;

(e) a pilot bracket, said pilot bracket having a plurality of holes for mating with said pin;

(f) fastening means for fastening said pilot bracket to an outboard motor powering said boat; and (g) locking means for locking said sleeve to said rod to fix the position of a rudder attached to said outboard motor.

8. The apparatus recited in claim 7, wherein said fastening means comprises a bolt and a nut.

9. The apparatus recited in claim 7, wherein said fastening means comprises:

(a) a plate, said plate having a plurality of holes;

(b) a plurality of bolts, said bolts extending through said holes in said plate, said bolts extending through holes in said pilot bracket; and (c) a plurality nuts, said nuts engaging said bolts, said plate and said pilot bracket positioned over the tiller of said outboard motor and clamped thereto.

10. The apparatus recited in claim 7, wherein said locking means comprises:

(a) a threaded receptacle, said receptacle attached to said sleeve, said receptacle positioned over a hole in said sleeve; and (b) a threaded bolt, said bolt having a first end and a second end, said first end of said bolt engaging said threads in said receptacle and extending through said hole in said sleeve, said second end of said bolt attached to a disc-shaped knob substantially perpendicular to one face of said knob, said knob having knurled edges.

11. A rudder positioning apparatus, comprising:

(a) a cylindrical rod, said rod having a first end and a second end, said first end including a first leg, the longitudinal axis of said first leg being substantially perpendicular to the longitudinal axis of said rod, and a second leg, the longitudinal axis of said second leg being substantially perpendicular to the longitudinal axis of said first leg;

(b) a mounting bracket, said mounting bracket for attachment to a wall of a boat, said mounting bracket having a hole, said second leg of said rod for insertion into said hole for articulation of said rod around a substantially vertical axis;

(c) a sleeve, said rod inserted through said sleeve, said sleeve being slidable over said rod;

(d) a pin, said pin attached to said sleeve, said pin oriented substantially perpendicular to the longitudinal axis of said sleeve;

(e) a pilot bracket, said pilot bracket having a plurality of holes for mating with said pin;

(f) fastening means for fastening said pilot bracket to an outboard motor powering said boat;

(g) a threaded receptacle, said receptacle attached to said sleeve, said receptacle positioned over a hole in said sleeve; and (h) a threaded bolt, said bolt having a first end and a second end, said first end of said bolt engaging said threads in said receptacle and extending through said hole in said sleeve, said second end of said bolt attached to a disc-shaped knob substantially perpendicular to one face of said knob, said knob having knurled edges whereby rotation of said knob locks said sleeve to said rod to fix the position of a rudder attached to said outboard motor.

12. The apparatus recited in claim 11, wherein said fastening means comprises a bolt and a nut.

13. The apparatus recited in claim 11, wherein said fastening means comprises:

(a) a plate, said plate having a plurality of holes;

(b) a plurality of bolts, said bolts extending through said holes in said plate, said bolts extending through holes in said pilot bracket; and (c) a plurality nuts, said nuts engaging said bolts, said plate and said pilot bracket positioned over the tiller of said outboard motor and clamped thereto.

* * * * *